US006634257B2

(12) United States Patent
Long et al.

(10) Patent No.: US 6,634,257 B2
(45) Date of Patent: Oct. 21, 2003

(54) SHARPENING METHOD AND APPARATUS FOR ROTARY KNIVES

(76) Inventors: John W. Long, 1003 S. 24th St., Omaha, NE (US) 68108; Dale R. Ross, 425 Liberty Dr., McPherson, KS (US) 67460

( * ) Notice: Subject to any disclaimer, the term of this patent is extended or adjusted under 35 U.S.C. 154(b) by 56 days.

(21) Appl. No.: 10/050,383

(22) Filed: Jan. 15, 2002

(65) Prior Publication Data

US 2003/0134579 A1 Jul. 17, 2003

(51) Int. Cl.[7] ..... B24B 3/36
(52) U.S. Cl. ..... 76/86; 76/82; 76/85; 451/45
(58) Field of Search ..... 76/82, 85, 88, 76/86; 451/45; 30/138, 276

(56) References Cited

U.S. PATENT DOCUMENTS 2,911,857 A * 11/1959 Garapolo ..... 76/85
2,933,865 A * 4/1960 Miller ..... 76/85
3,349,485 A * 10/1967 Bettcher ..... 30/138
3,406,486 A * 10/1968 Bettcher ..... 451/72
4,854,046 A * 8/1989 Decker et al. ..... 30/276
5,099,721 A * 3/1992 Decker et al. ..... 76/86

* cited by examiner

*Primary Examiner*—Hwei-Siu Payer
(74) *Attorney, Agent, or Firm*—Adam H. Jacobs

(57) ABSTRACT

A sharpening apparatus for a rotary knife blade includes a sharpening material support base and at least one lower sharpening device such as a metal pin mounted on the sharpening material support base. At least one upper sharpening device is mounted on the sharpening material support base, the upper sharpening device extending at an acute angle upwards above and relative to the lower sharpening device. The upper and lower sharpening devices are disposed relative to one another to generally simultaneously engage upper and lower surfaces of a blade to be sharpened and a guide device such as a curved wall structure is operative to releasably guide a blade between the upper and lower sharpening devices to assist with sharpening of a blade.

6 Claims, 2 Drawing Sheets

SHARPENING METHOD AND APPARATUS FOR ROTARY KNIVES

BACKGROUND OF THE INVENTION

1. Technical Field

The present invention is directed to sharpening methods and apparatuses for rotary defatting knives and, more particularly, to a sharpening tool for circular blades having at least one lower blade sharpening surface and an upper blade sharpening surface disposed and supported at an angle from the lower blade sharpening surface, the lower and upper blade sharpening surfaces operative to simultaneously engage the convergent faces of the circular blade and remove metal therefrom to create a pointed edge where the convergent faces meet.

2. Description of the Prior Art

The meat packing and processing industry has become increasingly important as the world population continues to grow thereby increasing the need for meat and meat products. As a result of the increased demand for meat, the meat packing industry had to become more efficient in its meat processing and packing operations. Through the use of improved technology and "assembly-line" like operations, the meat industry has been able to increase the production of meat and meat products. However, the industry requires individuals to use some form of knife to remove bones and trim the excess fat from the meat. Accordingly, the meat packing industry has attempted to produce knives that allow the user to debone and trim meat faster, safer, and more economically; a long-felt-need which has yet to be fully addressed.

The prior art discloses knives that typically have a handle, a drive mechanism, and a blade. Although there are numerous types of powered knives which are used, one of the more commonly used types includes a circular blade which rotates at a high rate of speed, the blade being rotatably supported on a handle. These knives are used to remove and trim fat from the carcass by "planing" the knife over the area on the carcass which is being trimmed and the spinning of the blade cuts the tissue being contacted to remove a strip from the carcass. It has been found that these types of blades are very efficient at removing tissue from the carcass, but there are inherent problems with the use of these knives that have not been solved by the prior art.

As with any knife, eventually the cutting edge of the circular blade of the knife becomes dull. This is especially true in the meat packing industry as the knives are used to cut through tough skin and sinew of the carcass. When an ordinary knife edge becomes dull, the user would merely sharpen the blade of the knife using any conventional sharpening apparatus. However, with a circular blade, the sharpening process is much more involved, and in the case of many of the types of circular blades used in the meat industry, it is often necessary to send the blade to the producing company for sharpening. Alternatively, the blade would be removed and replaced with a new blade. In the prior art, in order to change the blade, the knife would have to be replaced, as with the one-piece knife, or all the numerous screws or bolts would have to be removed. In either case, there will be a significant delay in the ability to use the knife blade. There is therefore a need for a sharpening apparatus and method which can be quickly and easily applied to the blade and permit rapid resumption of the use of the blade.

Many of the sharpening devices in the prior art are difficult and dangerous to use, as force must be applied to the sharpening stone or material to move it adjacent to the rotating blade. When the force is being applied, any slippage of the sharpening stone may bring the flesh of the user into contact with the rotating blade, thus causing a serious injury. Although other types of devices have been proposed to deal with this problem in connection with standard blades, the unique problems of the rotary blades have not yet been addressed, to the best of the inventors' knowledge. There is therefore a need for a sharpening apparatus and method which will be usable safely and efficiently in connection with rotary blades and knives.

Therefore, an object of the present invention is to provide a sharpening apparatus for rotary knife blades.

Another object of the present invention is to provide a sharpening apparatus for rotary knife blades that allows the blade to be sharpened quickly and easily.

Another object of the present invention is to provide a sharpening method for rotary knife blades that allows the blade to be sharpened safely, quickly and easily.

Finally, it is an object of the present invention to provide a sharpening apparatus for rotary knife blades which is relatively simple to manufacture and is safe and efficient in use.

SUMMARY OF THE INVENTION

The present invention is directed to a sharpening apparatus for a rotary knife blade which includes a sharpening material support base and at least one lower sharpening device such as a metal pin mounted on the sharpening material support base. At least one upper sharpening device is mounted on the sharpening material support base, the upper sharpening device extending at an acute angle upwards above and relative to the lower sharpening device. The upper and lower sharpening devices are disposed relative to one another to generally simultaneously engage upper and lower surfaces of a blade to be sharpened and a guide device such as a curved wall structure is operative to releasably guide a blade between the upper and lower sharpening devices to assist with sharpening of a blade.

The present invention also contemplates a method which includes the steps of providing a rotary knife blade having upper and lower surfaces and a sharpened edge therebetween, at least one lower sharpening device mounted on a sharpening material support base and at least one upper sharpening device mounted on the sharpening material support base, the upper sharpening device extending at an acute angle upwards above and relative to the lower sharpening device. The sharpening material support base is then positioned adjacent the rotary knife blade while the blade is rotating and the lower surface of the rotary knife blade is engaged by the at least one lower blade sharpening device. One of the rotary knife blade and the at least one upper sharpening device are moved until the at least one upper blade sharpening device contacts the upper surface of the rotary knife blade and then the at least one upper and lower blade sharpening devices each contact one of the upper and lower surfaces respectively of the rotary knife blade generally simultaneously, thus abrading the upper and lower surfaces of the rotary knife blade and sharpening the sharpened edge.

The present invention as thus described has many advantages over those devices found in the prior art. The sharpening apparatus is designed to receive the blade therewithin and allow the operator to quickly and easily sharpen the blade. Furthermore, the construction materials used in connection with the apparatus will quickly and safely sharpen even the most difficult rotary knife blade. Additionally, the shape and design of the apparatus will generally prevent accidents during its operation. Finally, the method of sharpening rotary blades taught by the present invention renders the invention far more efficient and safe for use than those methods and devices found in the prior art. Therefore, the present invention is seen to provide substantial improvements over those methods and devices found in the prior art.

DESCRIPTION OF THE PREFERRED EMBODIMENT

Figure 1:
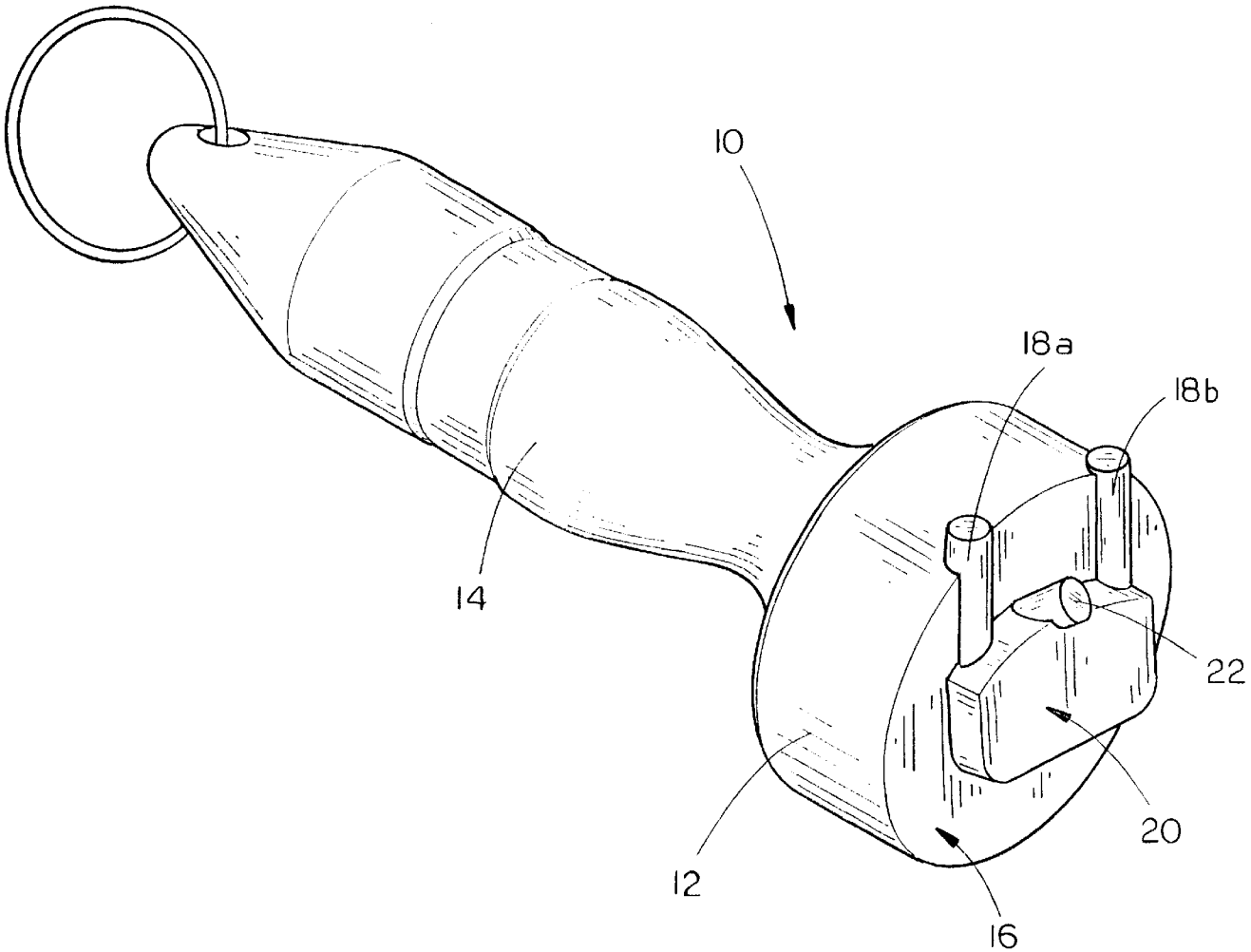
FIG. 1 is a perspective view of the sharpening apparatus of the present invention.
Figure 3:
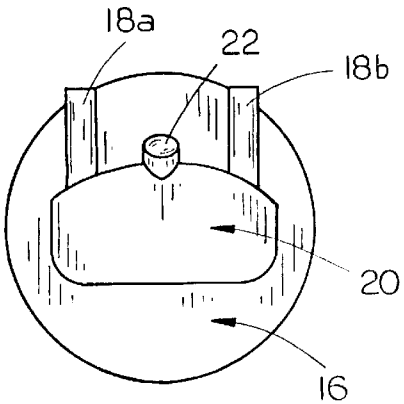
FIG. 3 is an top plan view of the apparatus of the present invention.
Figure 2:
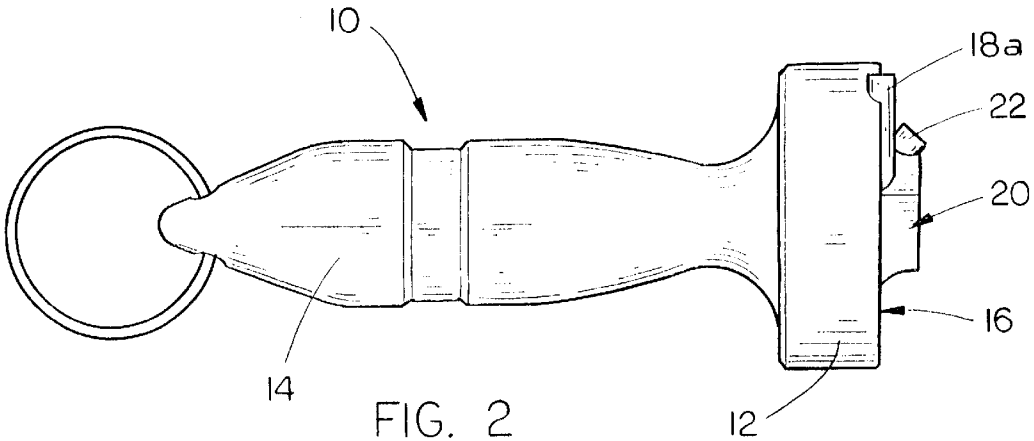
FIG. 2 is a side elevational view of the apparatus of the present invention.

The rotary blade sharpening apparatus 10 of the present invention is shown best in FIGS. 1–3 as including a sharpening material support base 12 which is mounted on a handle 14. In the preferred embodiment, the sharpening base 12 and handle 14 would be constructed of a high impact plastic material and would have dimensions of approximately 4 to 7 inches in length, 1 to 2 inches in width and be generally cylindrical in shape. Of course, it should be understand that handle 14 is merely illustrative of the type of handle that may be affixed to the sharpening material support base 12 and, in fact, sharpening material support base 12 may be mounted on any support surface such as a table top or the like, so long as the sharpening material base 12 is positioned to engage and sharpen a rotary blade 50.

Sharpening material support base 12 includes a first upper surface 16 on which a pair of lower blade sharpening pins 18*a* and 18*b* are mounted, the lower blade sharpening pins 18*a* and 18*b* extending generally parallel with first upper surface 16 of sharpening material support base 12 and projecting slightly above first upper surface 16 as shown best in FIGS. 1 and 2. In the preferred embodiment, lower blade sharpening pins 18*a* and 18*b* will be constructed as cylindrical pins made of a high strength metal material such as tungsten or the like which will abrade the rotary blade 50 as the blade contacts the lower blade sharpening pins 18*a* and 18*b* but, due to the high-strength construction material used in construction of lower blade sharpening pins 18*a* and 18*b*, will generally prevent abrasion of the pins, thus extending the useful life span of the rotary blade sharpening apparatus 10. Of course, it is to be noted that the precise number, size, shape and construction materials used in connection with the lower blade sharpening pins 18*a* and 18*b* may be modified or changed depending on the desired sharpening characteristics, and that such modifications are within the broad scope of this disclosure.

Extending upwards from and mounted on top of first upper surface 16 of sharpening material support base 12 is pin support block 20, shown best in FIGS. 1, 2 and 3, which includes a curved forward edge which has a radial curvature approximately equal to the radial curvature of the sharpened edge 56 of rotary blade 50, and thus acts as a guide for the blade 50 during the sharpening process to further prevent accidental slippage of the blade 50 from rotary blade sharpening apparatus 10. Mounted on pin support block 20 is upper blade sharpening pin 22 which extends upwards and outwards from pin support block 20 at an angle relative to lower blade sharpening pins 18*a* and 18*b*. It is preferred that upper blade sharpening pin 22 be constructed the same material as used in connection with lower blade sharpening pins 18*a* and 18*b* and further that upper blade sharpening pin 22 be positioned such that when the lower blade sharpening pins 18*a* and 18*b* engage the lower surface 52 of the rotary blade 50, upper blade sharpening pin 22 simultaneously engages the upper surface 54 of rotary blade 50 that simultaneously grinding and abrading the lower and upper surfaces 52 and 54 to create a sharpened edge 56 for the rotary blade 50. Of course, the precise angle, between the upper blade sharpening pin 22 and lower blade sharpening pins 18*a* and 18*b* will be determined by the diameter in size of the rotary blade 50 which is being sharpened by the rotary blade sharpening apparatus 10 of the present invention. Such modifications of the angle of upper blade sharpening pin 22 to lower blade sharpening pins 18*a* and 18*b*, while important to the functionality of the present invention, is to be determined by further experimentation and thus may not be a part of this disclosure.

Figure 4:
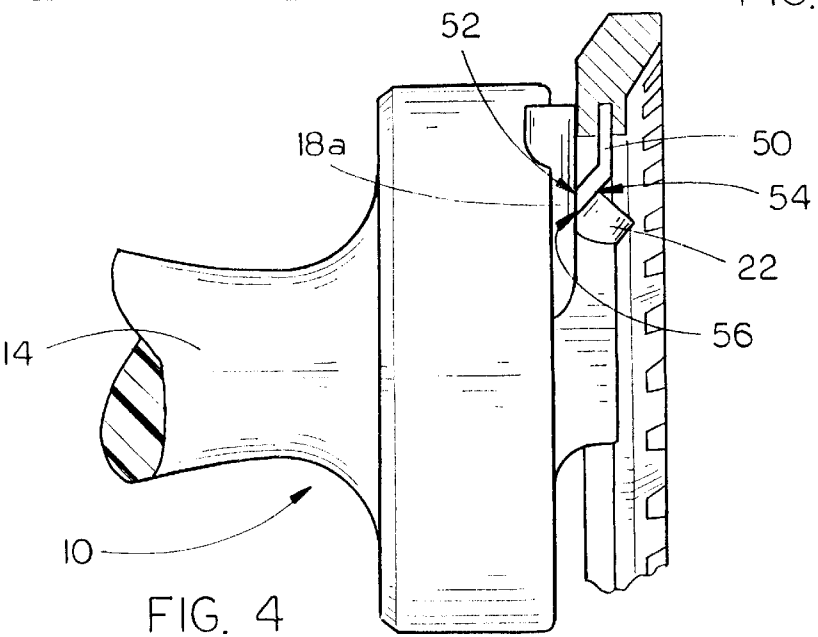
FIG. 4 is a detail side elevational view of the method of the present invention.

The method of use of the rotary blade sharpening apparatus 10 of the present invention is shown best in FIG. 4 and includes the following steps. The user would position the sharpening material support base 12 adjacent the rotary blade 50 to be sharpened, preferably while the blade 50 is rotating, specifically with the lower blade sharpening pins 18*a* and 18*b* contacting the lower surface 52 of the rotary blade 50. The apparatus 10 would then be moved outwards from the center of the rotary blade 50 until the upper blade sharpening pin 22 contacts the upper surface 54 of the rotary blade 50. The upper and lower surfaces 54 and 52 of rotary blade 50, which are convergent, thus contact the upper and lower blade sharpening pins 22, 18*a* and 18*b* simultaneously, thus abrading the upper and lower surfaces 54 and 52 at approximately equal rates and sharpening sharpened edge 56. Importantly, the angle between lower blade sharpening pins 18*a* and 18*b* and upper blade sharpening pin 22 is approximately equal to the angle between the lower and upper surfaces 52 and 54 of the rotary blade 50. This ensures that the abrading of the surfaces does not result in a degradation of the strength of the rotary blade 50 and further permits even relatively unskilled users to properly sharpen the rotary blade 50, a critical improvement over the prior art due to the generally low level of experience and education found on the floor of a typical meat processing facility.

It should also be noted that the extended diameter of the sharpening material support base 12 compared with the handle 14 prevents engagement of the blade with the user's hand if an accidental slippage should occur. However, slippages are generally prevented due to the secure engagement of the blade 50 by the upper and lower blade sharpening pins 22, 18*a* and 18*b* during the sharpening procedure. Furthermore, as was discussed previously, the curved forward edge of the pin support block 20 has a radial curvature approximately equal to the radial curvature of the sharpened edge 56 of rotary blade 50, and thus acts as a guide for the blade 50 during the sharpening process to further prevent accidental slippage of the blade 50 from rotary blade sharpening apparatus 10.

It is therefore to be understood that numerous modifications, additions and substitutions may be made to the rotary blade sharpening apparatus 10 and method of use thereof of the present invention which fall within the intended broad scope of the preceding disclosure. For example, the size, shape and dimensions of the rotary blade sharpening apparatus 10 may be modified or changed to fit the various rotary blades used in the meat packing industry, as long as the intended function of quickly, easily and safely sharpening the blade is maintained. Also, the exact sharpening material from which the sharpening pins are constructed is not critical so long as the sharpening characteristics of the pins are maintained. Finally, the sharpening pins need not be mounted in the manner described above so long as the pins are mounted to engage the rotary blade or other blade to be sharpened therein. For example, the pins could be mounted on a tabletop adjacent the rotary knife user's location and he or she could merely move the rotary knife blade into contact with the sharpening apparatus 10 of the present invention.

There has therefore been shown and described a rotary blade sharpening apparatus and method which accomplishes at least all of its intended objectives.

We claim:

1. A sharpening apparatus for a rotary knife blade comprising;

a sharpening material support base;

at least one lower sharpening means mounted on said sharpening material support base;

at least one upper sharpening means mounted on said sharpening material support base, said upper sharpening means extending at an acute angle upwards above and relative to said lower sharpening means;

said upper and lower sharpening means disposed relative to one another to generally simultaneously engage upper and lower surfaces of a blade to be sharpened; and guide means operative to releasably guide a blade between said upper and lower sharpening means to assist with sharpening of a blade.

2. The sharpening apparatus of claim 1 wherein said at least one lower sharpening means comprises at least two generally cylindrical sharpening pins mounted on and extending slightly above said sharpening material support base.

3. The sharpening apparatus of claim 2 wherein said at least one upper sharpening means comprises at least one upper blade sharpening pin which extends upwards and outwards from said sharpening material support base at an angle relative to said at least two generally cylindrical sharpening pins, said at least one upper blade sharpening pin positioned such that upon said at least two generally cylindrical sharpening pins engage a lower surface of a rotary blade, said at least one upper blade sharpening pin generally simultaneously engages an upper surface of a rotary blade thereby simultaneously grinding and abrading the lower and upper surfaces to create a sharpened edge for a rotary blade.

4. The sharpening apparatus of claim 1 further comprising a handle mounted on said sharpening material support base.

5. A sharpening apparatus for a rotary knife blade comprising in combination;

a rotary knife blade having upper and lower surfaces and a sharpened edge therebetween; and a sharpening material support base;

at least one lower sharpening means mounted on said sharpening material support base;

at least one upper sharpening means mounted on said sharpening material support base, said upper sharpening means extending at an acute angle upwards above and relative to said lower sharpening means; and said upper and lower sharpening means disposed relative to one another to generally simultaneously engage said upper and lower surfaces of said rotary knife blade and abrade said upper and lower surfaces to increase the sharpness of said sharpened edge.

6. A method of sharpening a rotary knife blade comprising the steps;

providing a rotary knife blade having upper and lower surfaces and a sharpened edge therebetween, at least one lower sharpening means mounted on a sharpening material support base and at least one upper sharpening means mounted on said sharpening material support base, said upper sharpening means extending at an acute angle upwards above and relative to said lower sharpening means;

positioning said sharpening material support base adjacent said rotary knife blade while said blade is rotating;

engaging said lower surface of said rotary knife blade with said at least one lower sharpening means;

moving one of said rotary knife blade and said at least one upper sharpening means until said at least one upper sharpening means contacts said upper surface of said rotary knife blade; and said at least one upper and lower sharpening means each contacting one of said upper and lower surfaces respectively of said rotary knife blade generally simultaneously, thus abrading said upper and lower surfaces of said rotary knife blade and sharpening said sharpened edge.

* * * * *